United States Patent [19]

McCabe

[11] 4,301,569

[45] Nov. 24, 1981

[54] QUADRANT OPERATOR

[76] Inventor: Francis J. McCabe, 239 Hastings Ct., Doylestown, Pa. 18901

[21] Appl. No.: 16,514

[22] Filed: Mar. 1, 1979

Related U.S. Application Data

[60] Continuation-in-part of Ser. No. 905,211, May 12, 1978, Ser. No. 896,299, Apr. 14, 1978, Pat. No. 4,195,384, Ser. No. 896,237, Apr. 14, 1978, and Ser. No. 764,774, Feb. 2, 1977, which is a continuation of Ser. No. 689,994, May 26, 1976, Pat. No. 4,081,173, said Ser. No. 905,211, is a division of Ser. No. 729,831, Oct. 4, 1976, Pat. No. 4,113,232, said Ser. No. 896,299, is a continuation-in-part of Ser. No. 779,044, Mar. 18, 1977, Pat. No. 4,099,292, which is a continuation-in-part of Ser. No. 676,483, Apr. 13, 1976, Pat. No. 4,041,570, and Ser. No. 676,413, Apr. 13, 1976, Pat. No. 4,040,304.

[51] Int. Cl.[3] ..... E05F 15/20

[52] U.S. Cl. ..... 16/48.5; 49/1

[58] Field of Search ..... 16/48.5; 49/1, 2, 3, 49/4, 51; 137/601; 160/1, 6, 9

[56] References Cited

U.S. PATENT DOCUMENTS

| | | | |
|---|---|---|---|
| 980,443 | 1/1911 | Shuman . | |
| 1,368,453 | 2/1921 | Ream . | |
| 1,573,930 | 2/1926 | Gilmore | 49/4 |
| 2,474,760 | 6/1949 | Smith | 49/2 |
| 2,581,321 | 1/1952 | Fletcher . | |
| 2,654,921 | 10/1953 | Blanchard . | |
| 2,759,573 | 8/1956 | Schwab . | |
| 2,803,319 | 8/1957 | Johnson | 49/1 |
| 2,996,768 | 8/1961 | Brown . | |
| 3,273,632 | 9/1966 | McCabe . | |
| 3,327,764 | 6/1967 | McCabe . | |
| 3,540,154 | 11/1970 | Claudio . | |
| 3,543,439 | 12/1970 | Pautland . | |
| 3,725,972 | 4/1973 | McCabe . | |
| 3,727,663 | 4/1973 | McCabe . | |
| 3,741,102 | 6/1973 | Kaiser . | |
| 3,796,248 | 3/1974 | McCabe . | |
| 3,814,165 | 6/1974 | McCabe . | |
| 3,866,656 | 2/1976 | McCabe . | |
| 3,889,314 | 6/1975 | McCabe . | |
| 3,899,156 | 8/1975 | McCabe . | |
| 3,908,529 | 9/1975 | McCabe . | |
| 3,996,952 | 12/1976 | Root | 137/601 |
| 4,041,570 | 8/1977 | McCabe . | |
| 4,074,388 | 2/1978 | McCabe . | |
| 4,099,292 | 7/1978 | McCabe . | |
| 4,113,232 | 9/1978 | McCabe . | |

FOREIGN PATENT DOCUMENTS

| | | |
|---|---|---|
| 1513298 | 1/1968 | France . |
| 907 | of 1904 | United Kingdom . |

*Primary Examiner*—Andrew V. Kundrat
*Attorney, Agent, or Firm*—Benasutti Associates, Ltd.

[57] ABSTRACT

A novel operator for use with a damper is disclosed comprising a plurality of pivotally interconnected damper operator members which are pivotally associated with the damper blade linkage and frame, such that they may be moved to an over-center locking position to lock the damper blades in their desired fire actuated positions. The operator also comprises an actuator means for selectively acting through the operator to control the degree of blade opening, and a releasing device for responding to various activation conditions, such as heat, for disengaging the actuator from the operator members to facilitate closure and automatic locking of the blades. The operator members may also be springed biased to automatically accomplish blade closure.

20 Claims, 7 Drawing Figures

QUADRANT OPERATOR

CROSS-REFERENCE TO RELATED APPLICATIONS

The present application is a continuation-in-part of my prior co-pending patent application Ser. No. 896,299, filed Apr. 14, 1978, now U.S. Pat. No. 4,195,384 which in turn is a continuation-in-part of my prior co-pending patent application Ser. No. 779,044, filed Mar. 18, 1977 entitled, "Telescoping Heat Responsive Releasing Means," now U.S. Pat. No. 4,099,292, dated July 11, 1978, which in turn is a continuation-in-part of my prior co-pending patent application entitled, "An Electrical Pneumatic Heat Actuated Fire Link Apparatus," Ser. No. 676,483, filed Apr. 13, 1976, now U.S. Pat. No. 4,041,570, dated Aug. 16, 1977, as well as, a continuation-in-part of my prior co-pending patent application entitled, "Clutch Motor For Use In Resettable Fire Damper," Ser. No. 676,413, filed Apr. 13, 1976, now U.S. Pat. No. 4,040,304, dated Aug. 9, 1977, which applications are incorporated herein by reference as if fully set forth herein.

The present application is also a continuation-in-part of my prior co-pending patent application Ser. No. 764,774, filed Feb. 2, 1977 entitled, "Rotating Blade Fire damper," which in turn is a continuation of application Ser. No. 689,994, filed May 26, 1976 entitled, "Rotating Blade Fire Damper," now U.S. Pat. No. 4,081,173, dated Mar. 28, 1978, which applications are also incorporated by reference as if fully set forth herein.

The present application is also a continuation-in-part of my prior co-pending patent application entitled, "Electro-Thermal Fire Protection Locking Clip," Ser. No. 896,237, filed, Apr. 14, 1978, which application is also specifically incorporated herein by reference.

The present application is also a continuation-in-part of U.S. patent application Ser. No. 905,211, filed May 12, 1978 entitled, "Smoke, Fire and Air Control Damper With Stamped Blade Hinge," which in turn is a division of U.S. Ser. No. 729,831, filed Oct. 4, 1976, now U.S. Pat. No. 4,113,232, dated Sept. 12, 1978, each of which applications are hereby incorporated by reference as if fully set forth herein.

BACKGROUND OF THE INVENTION

The present invention generally relates to the field of damper operators, and more particularly, damper operators employing releasing devices such as bimetals or other heat responsive means which are used to actuate various fire protection equipment, such as their associated dampers, either in response to increases to heat in the vicinity of the device or in response to remote signals received thereby.

The present invention is particularly adapted for use with dampers comprising a frame having one or more rotating blades mounted therein. Conventionally, such dampers are provided with blade linkages which articulate the blades with respect to the frame so that the blades will move in unison between their open and closed positions with respect to the frame. It has long been known that such dampers may be operated using cables attached to the blade brackets or blade linkages of these dampers, which cables are normally threaded through a ferrule disposed through the damper/duct wall to reach an operator motor mounted outside of the duct in which the damper is located. It is also known to bias the blades towards the closed position, as for example, using springs extending between the damper frame and the blades, and to provide fusible links in the cable portion located within the duct so that, in response to increased temperatures within the duct, the cable will break and the spings cause the blades to move to the closed position, whereupon the passage of fire through the duct will be halted. Similar alternative arrangements have also been used for smoke dampers which are intended to move to the open position in response to the presence of smoke, and the herein below described invention is equally as applicable for use with such dampers.

Alternatively, it is known to operate dampers through a damper operator shaft, the rotation of which through an arc of 90° corresponds to the rotation of the damper blades through 90° between their open and closed positions. See, for example, the various damper operators disclosed in my prior issued U.S. Pat. No. 4,113,232, data Sept. 12, 1978 entitled, "Smoke, Fire And Air Control Damper With Stamped Blade."

For other damper, blade linkage, spring biasing, and operator constructions, please refer to the following U.S. Pat. Nos. 2,581,321; 2,654,921; 2,759,573; 2,996,768; 3,273,632; 3,327,764; 3,540,154; 3,727,663; 3,741,102; 3,814,165; 3,866,656; 3,899,156; 3,908,529; 1,368,453; 3,273,632; 3,908,529; 3,273,632; 3,543,439; and 3,908,529; British Specification No. 907, dated Jan. 13, 1904 and French Pat. No. 1,513,298.

Motorized operators for use in rotating damper operating shafts through an arc of 90° are known. Such motorized operators normally may be controlled from a remote source to adjust air flow through the damper by rotating the damper blades a preselected number of degrees from the closed towards the open position, which degrees are normally assumed to correspond to the percentage of air flow through that damper. For example, a 10° movement of the shaft normally corresponds to a 10° opening of the damper which is assumed to establish a corresponding air flow approximately 11° through the damper. In actuality, however, the relationship between arc of blade opening and air flow is not linear. In particular, during the initial stages of blade opening, correspondingly greater percentage volumes of air are permitted to pass through the damper for a given degree of blade opening, while as the damper blades approach their fully open positions correspondingly smaller increases in air flow are achieved per a given degree of blade rotation. No damper/operator unit is presently known having air flow characteristics which exhibit a substantially linear relationship between air flow and degree of operator shaft rotation.

While shaft/operated dampers may be preferred in certain instances, such operators are typically difficult and expensive to install, primarily due to the fact that such operators normally must be installed to the damper frame after that damper has been installed within the duct. Such a requirement makes installation difficult and expensive, often resulting in improperly installed damper-operator combinations.

SUMMARY OF THE INVENTION

The present invention provides a sophisticated, easy to install damper/operator combination exhibiting many advantages over those heretofore known to the art.

The present operator provides a unique over-center locking arrangement for insuring that the blades stay in their desired actuated (closed) position even in the presence of excessive heat and/or pressure, such as may be encountered under fire conditions. Once fire actuating conditions have been sensed, the actuator, such as a motor or a cable, cannot unlock the damper from its actuated position at least until fire actuating conditions have passed. The actuating motor may then be recycled through its normal 90° arc of travel to automatically reset the operator for continued use.

The preferred embodiment operators are readily adapted for cable or shaft actuation, and may incorporate either fusible or bimetallic releasing devices. Additionally, they may be constructed to automatically bias the damper blades to their fire actuated position, or alternatively, may rely upon other biasing or closure mechanisms to accomplish closure of the blades. In either instance, the blades will be locked in an over-center position upon actuation thereof and cannot be opened by the actuating means or forces applied to the blades until either manually reset or, in the preferred embdiment, automatically reset and only after the fire actuating conditions have passed.

In accordance with the preferred embodiment of the present invention, the fire damper comprises a plurality of pivotally interconnected damper operator members which are pivotally associated with the frame and with the linkage means of the damper. One of these members, a frame associated operator member, defined an operating arc of between about 82° and 89° which causes the blades to move between their closed and their open position. The frame associated operator member additionally travels through a locking portion of its arc which is greater than 0° and less than 7° to accomplish an over-center locking of the blades.

In the preferred embodiment, a shaft-type actuating means is provided which is selectively interconnected with the frame associated operating member by a releasing device which permits normal operation of the damper between its open and closed positions except in response to fire actuating conditions, such as heat, whereupon the actuator means is disengaged from the frame associated member. Biasing means associated with the operator (or other biasing means located elsewhere, if desired) will then drive the operator into its locked over-center position. Once locked, substantial forces which may tend to alter the blade position will be resisted by the over-center locking of the damper operator.

A novel assembly method is also provided which enables an operator mounting bracket to be mounted on a portion of the frame during the initial construction of the damper. Once the damper frame is in place, a hole is simply drilled through the wall of its associated duct and the various operator parts assembled by sliding the operator shaft through a hole in the frame associated member and mounting bushing and then by rotating that shaft into a position with its normal operating and/or locking arcs. If spring biasing of the operator is desired, a coiled spring may then be manually applied to engage various bias mounting portions of the operator. In this manner, no special tools or delicate operations are necessary for final installation.

Accordingly, a primary object of the present invention is the provision of a simple, reliable, improved damper operator.

A further object of the present invention is the provision of an easily installed damper operator.

A further aim of the present invention is the provision of a fail-safe, damper operator which may be automatically resettable.

A further object of the present invention is the provision of a shaft operated damper operator wherein, at least during the initial phases of blade opening, the percentage of air flow corresponds in a substantially linear fashion to the degree of shaft rotation of the damper operator.

These and other objects of the present invention will become apparent from the following more detailed description.

DETAILED DESCRIPTION OF THE PREFERRED EMBODIMENT

Figure 2:
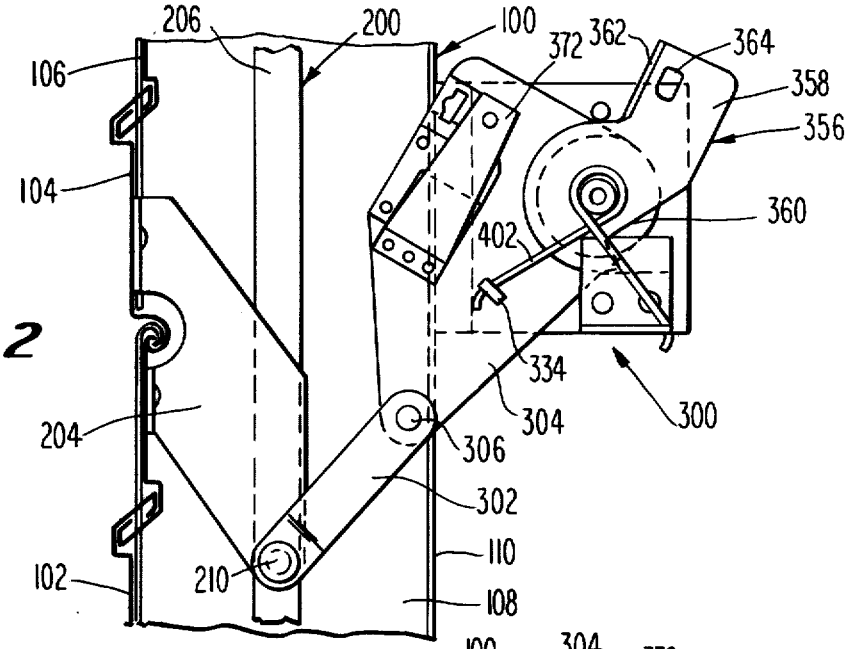
FIG. 2 is fragmentary view of a portion of the damper and operator shown in FIG. 1 wherein the damper operator is in its locked, over-center position as the result of the release of the actuating means by the releasing device mounted on the frame associated operator member.

Although specific forms of the invention has been selected for illustration in the drawings, and the following description is drawn in specific terms for the purpose of describing these forms of the invention, this description is not intended to limit the scope of the invention which is defined in the appended claims.

The present invention basically comprises an operator for operating a damper having a frame, at least one blade, and blade linkage means connected to said blade for articulating the blade with respect to the frame. In its normal installation this operator is intended to permit or cause closure of the blade(s) to their fully closed position with respect to the frame, as for example, in response to fire actuating conditions such as heat or remote fire alarm signals, and to maintain those blades in the closed position at least until the fire actuating conditions have passed. In the following description and claims, it is assumed that the desired fire actuating position of the blades is the fully closed position with respect to the frame, however, one of ordinary skill in this art will understand that if the damper is to be used as a smoke damper, the desired fire actuated position may be the fully open position of the damper, whereupon the damper operator shall be mounted so that is assumes the locked, over-center position when those blades are fully opened.

Figure 1:
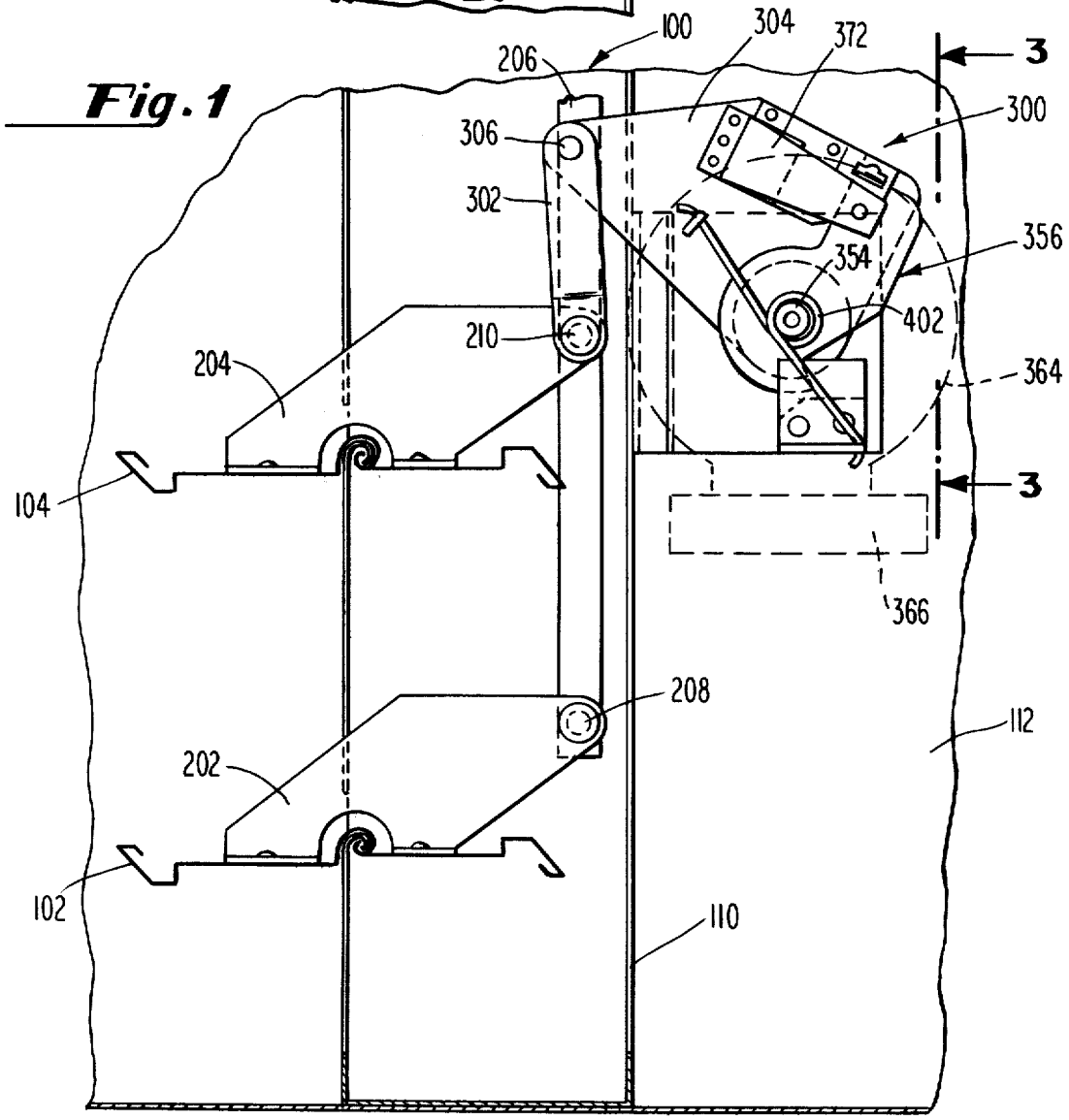
FIG. 1 is a cross-sectional side view of the preferred embodiment damper operator shown mounted to the linkage means of a damper whose blades are held in the open position, the entire unit being shown mounted within a fragmentary portion of a duct.
Figure 5:
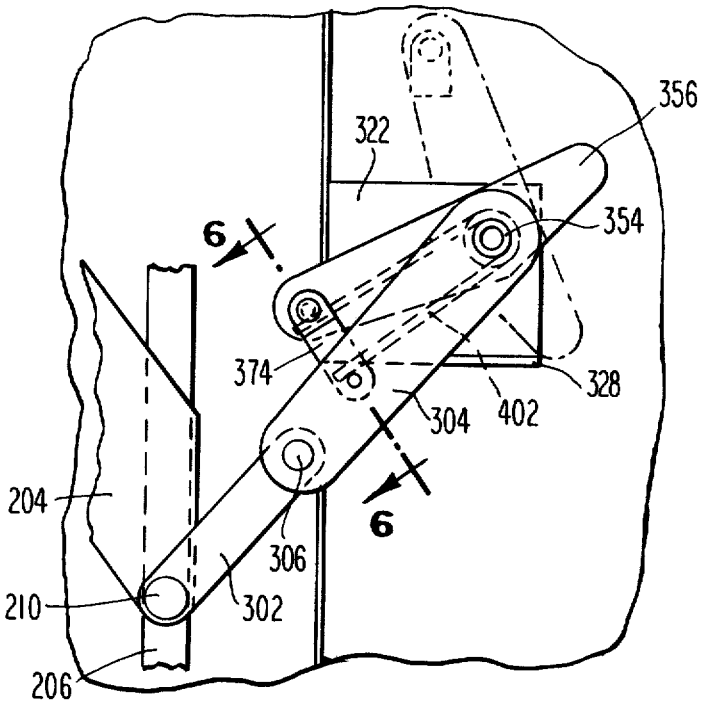
FIG. 5 is a cross-sectional side view of a portion of a damper and duct showing a first alternate embodiment shaft-operated, spring-biased, fusible-link-containing operator in accordance with the present invention.
Figure 7:
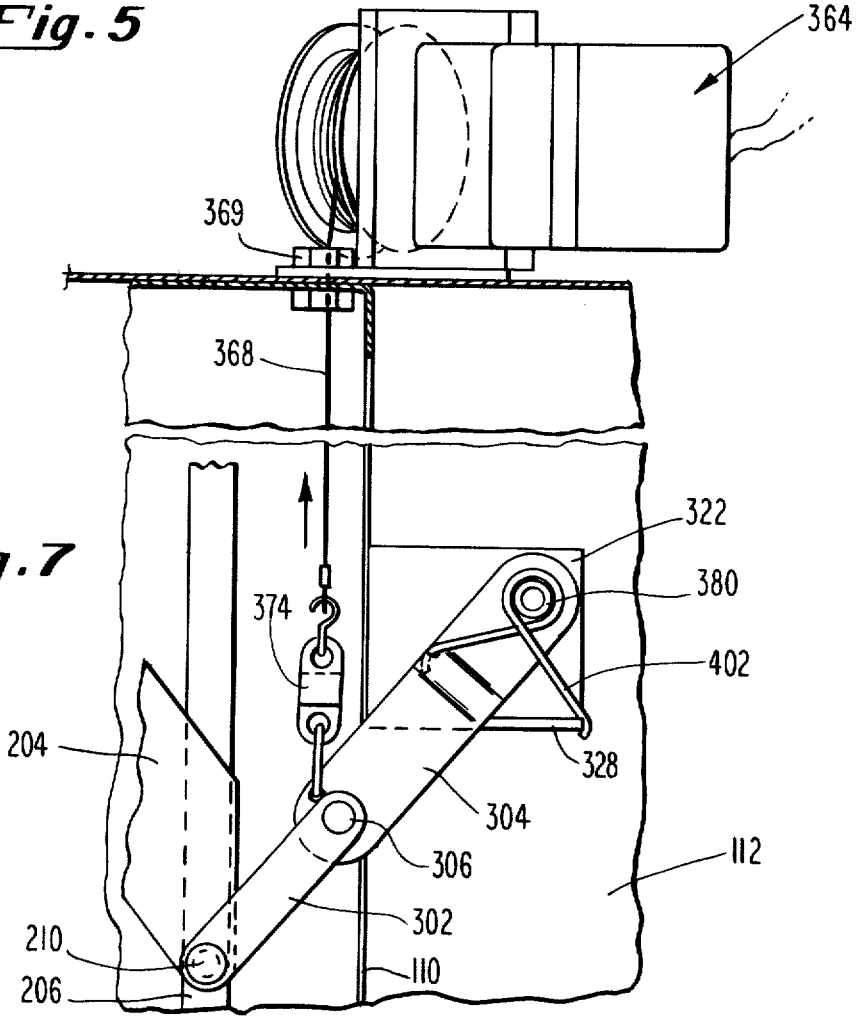
FIG. 7 is a cross-sectional side view of a portion of a damper and second alternate embodiment operator and motor-cable actuator.

In the drawings, the preferred embodiment damper operators are shown in association with a preferred damper, designated generally 100, having damper blades 102, 104 and 106 which are disposed within frame 108 having at least one inwardly depending frame flange 110 on which the damper operator may be mounted. In FIGS. 1, 5 and 7 this damper is shown mounted within a duct 112. For additional details relating to the preferred embodiment rotating blade damper which may be used with the preferred embodiment opertors of the present invention, please refer to the above cross-referenced patent applications and patents relating to such dampers, the disclosures of which have been incorporated herein by reference. In the figures, the illustrated dampers are seen to comprise linkage means for articulating the blades with respect to the frame. This linkage means comprises blade brackets 202 and 204, linkage bar 206 and linkage bar pivots 208 and 210. Movement of the linkage bar through an arc defined by the radius between its pivots 208 and 210 and their respective blade pivots causes the blades to move between their open and closed positions.

In FIGS. 1-4, the preferred embodiment damper operator designated generally 300 is illustrated. This damper operator comprises linkage associated operator member 302 and frame associated operator member 304 which are pivotally interconnected by operator member pivot 306. The linkage associated operator member 302 is pivotally mounted with respect to the damper frame by mounting means 320. This mounting means comprises a frame mounting bracket 322 which is connected to frame flange 110, a bushing bracket 324 connected to the frame mounting bracket, and a bushing means 326 for defining a bore in the mounting means to receive shaft 354. A stop means 328 for limiting the arc of rotation of at least the frame associated member 304 is also mounted on frame mounting bracket 322. By limiting the arc of rotation of said frame associated member 304, the stop means defines an over-center position wherein operator member pivot 306 has passed over a line described by the linkage bar pivot 210, which connects linkage associated operator member 302 to the linkage, and shaft 354 which pivotally connects the frame associated operator member 304 to the frame through frame mounting bracket 322. This over-center position will effectively resist any "opening" forces which may be transferred to the operator through linkage bar 206, such as may result under fire actuating conditions. In the preferred embodiment, the mounting means additionally comprises an L-bracket 329 having a bias mount portion 330 and an actuator interlock portion 332. The actuator interlock portion 332 cooperates with bias mounting pin 334 and a protruding portion of shaft 354 to act as a mount for biasing spring 402. This biasing spring 402 biases the frame associated member 304 into its over-center locked position by spanning between the bias mount portion 330 and bias mounting pin 334. Under normal operating conditions the actuator means for selectively causing the rotation of the frame associated member at least in a first direction away from the over-center locking position will effectively counteract forces applied by the bias mounting spring. Under fire actuating conditions, however, the releasing device, such as bimetallic releasing device 372 will disengage the frame associated member 304 from the actuator means to allow the biasing spring to drive the operator into its locked over-center position, thereby closing and locking the damper.

In the preferred embodiment, the above-mentioned actuator means may comprise either a shaft means for selectively causing the rotation of the frame associated member in said first direction or a cable means for accomplishing the same result. In FIGS. 1-5 shaft-type actuator means are disclosed wherein shaft 354 extends through duct wall 112 for connection to an operator motor 364 shown externally supported on motor mount 366. Each shaft means is provided with an actuator plate which is rigidly attached to the shaft for rotation therewith, as for example, by welding. The shaft actuator plate 356 comprises a frame associated member connecting portion 358 which is generally remotely located with respect to the shaft, an actuator interlock cut-out 360 which cooperates with actuator interlock portion 332 (as described hereinafter), an actuator resetting edge 362 and a releasing device reception slot 364. In FIG. 1, the actuator plate 356 is shown in its engaged position wherein a pin of bimetallic releasing device 372 is disposed within slot 364 to interconnect the actuator plate 356, and more particularly, the frame associated member connecting portion 358 thereof with the frame associated operating member 304. Under these conditions, rotation of shaft 354 through its normal 90° arc will cause the blades to move between their fully open and fully closed positions through an operating portion of the arc which is between 75° and 95°, preferably 83° to 89°, and may travel beyond said operating portion of said arc through a locking portion of said arc of rotation to the over-center locking position to lock the blades with respect to the frame. In the preferred embodiment, the locking portion of this arc is greater than 0° but less than 7°, preferably 1° to 4°, of the arc of rotation of the shaft.

In the presence of fire actuating conditions, the releasing means for releasing the frame associated member from the actuator means preferably comprises a bimetallic releasing device similar to that described in my prior issued U.S. Pat. Nos. 3,889,314; 4,041,570; 3,725,972; and 4,074,388, each of which patents are hereby incorporated by reference. This releasing device will respond either to increases in ambient temperature in the vicinity of the damper (within the duct) or to remote signals received by that device. In either instance, the releasing device will disengage itself from the slot 364 defined in actuator plate 356, whereupon the biasing means will drive the operator and associated fire damper into its fire actated, over-center, locked position. As long as fire actuating conditions persist, reciprocation of the actuator means through its full normal arc of rotation will not cause re-engagement of the actuator plate 356 with the releasing device 372, and therefore will not be effective in moving the operator out of its over-center locked position. Once normal conditions have been re-established, however, a beveled, actuator resetting edge 362 will effectively engage and lift a portion of the tip of a bimetallic releasing device 372 so that tip or pin of the releasing device may slide across a surface of the actuator plate to snap into slot 364. In this manner, recycling of the operator after fire conditions have passed will cause the operator to automatically reset.

Figure 4:
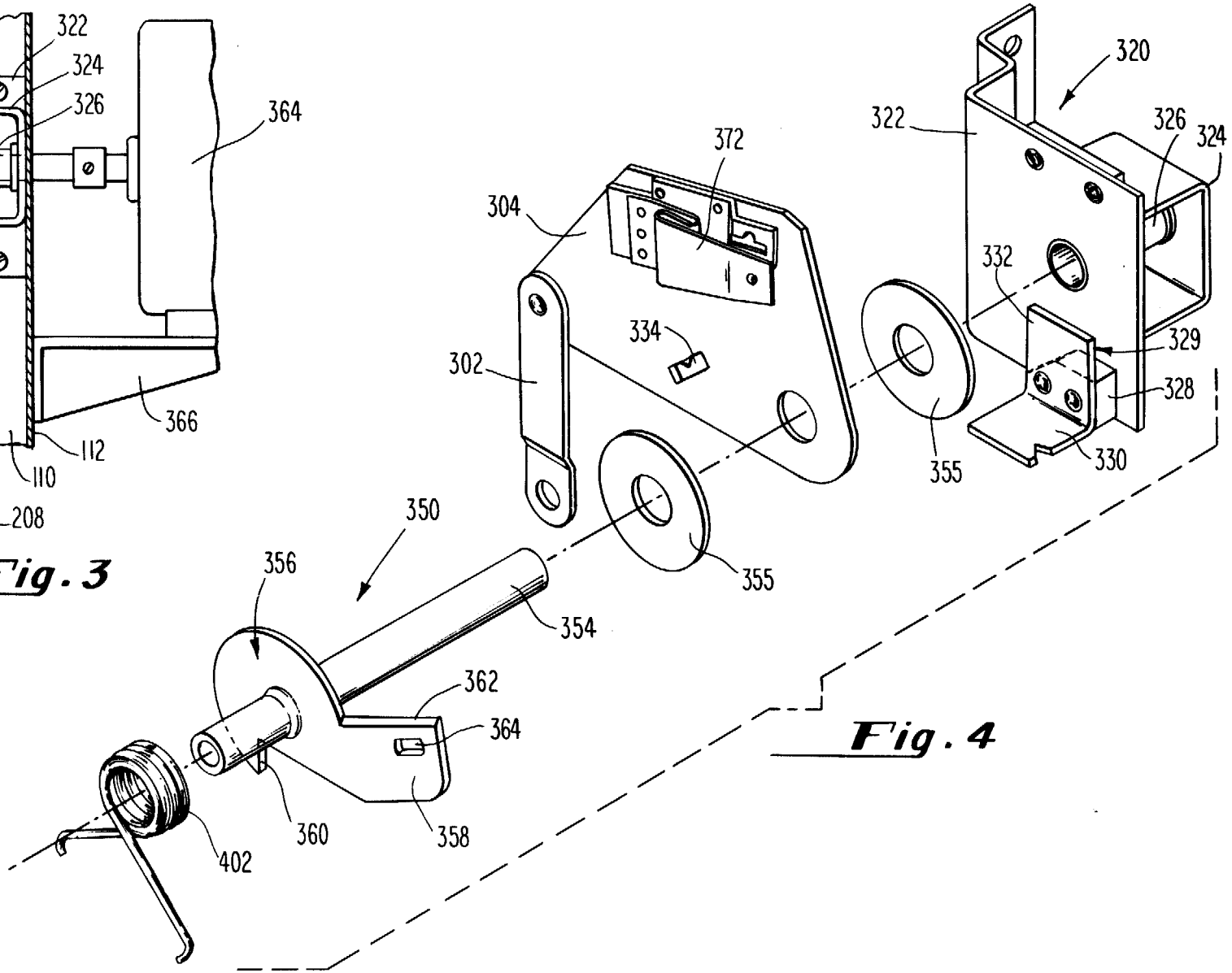
FIG. 4 is an exploded isometric view of the preferred embodiment damper operator illustrated in FIGS. 1-3 illustrating the assembly of that damper/operator.
Figure 3:
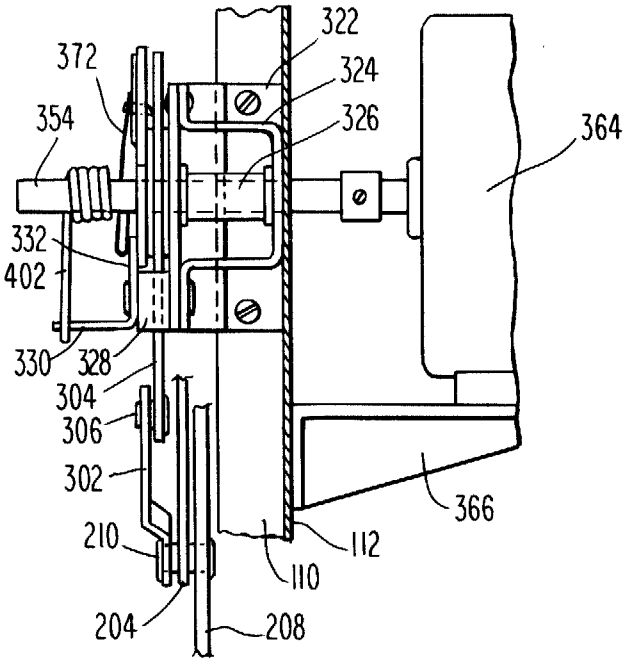
FIG. 3 is a cross-sectional side view of the device illustrated in FIG. 1 taken as indicated by the lines and arrows 3—3 in FIG. 1.

FIG. 4 clearly illustrates the ease with which the preferred embdiment operator may be assembled on the job site. Preferably, mounting means 320 will be riveted or otherwise attached to an inwardly depending flange, such as flange 110, of the damper upon the initial construction of the damper, or at least prior to the installation of the damper within the duct. Linkage bar pivot 210 may similarly be connected to linkage associated operating member 302 prior to final installation. For final installation, the biasing means 402, actuator means 350 and washers 355 may be temporarily removed from the damper/operator unit during a first phase of final assembly. Once this damper/operator unit is installed within the duct, a bore corresponding to the interior dimension of bushing 326 may be drilled in the duct wall, whereupon the actuator means oriented in the relative rotational position shown in FIG. 4 may be threaded through washers 355, a shaft receiving bore in frame associated operator member 304 and finally through bushing 326 whereupon shaft 354 will protrude out of the duct in which the damper/operator unit has been installed. The actuator interlock cutout 360 and actuator interlock portion 332 are complimentally configured so that at least in one relative rotational position, axial movement of the shaft 354 with respect to bushing 326 is permitted. These portions are also configured so that through the normal operating and locking arcs of rotation of the shaft and actuator plate 356, relative axial movement of the shaft within the bushing is prevented. In this manner, no special tools will be required for final assembly of the operator within the duct. Similarly, application of the biasing means 402 is easily accomplished by slipping the coiled portion of the biased means over a protruding portion of the shaft and manually applying the protruding tips thereof over the bias mounting pin 334 and bias mount portion 330 respectively.

In FIG. 5, a first alternate embodiment of the operator of the present invention is illustrated. This operator retains some of the features of the preferred embodiment operator illustrated in FIGS. 1–4, yet at lower costs. In this figure, corresponding portions of the operator have been numbered in a corresponding manner to those numbers used in FIGS. 1–4, however the shapes of the corresponding elements have been somewhat altered to simplify their design. In FIG. 5, the mounting bracket is seen to be a substantially L-shaped bracket having a perpendicular flange 328 formed thereon which acts as a stop means not only for limiting the arc of rotation of the frame associated member 304, but also for limiting the arc of rotation of actuator plate 356 in the opposite direction. This variation is necessary by reason of the alternate position of spring 402 which in this embodiment spans between remote portions of the actuator plate 356 and frame associated member 304. A fusible link 374 also spans between these members, so that upon normal operation of the device, the rotation of shaft 354 will cause rigidly interconnected actuator plate 356 to rotate therewith and to drive pivotally associated frame associated member 304 through fusible link 374. In response to heat in the vicinity of the fusible link, the fusible link will separate, at least causing the frame associated member to move to its over-center locked position, which is the position of that member illustrated in FIG. 5. The locking of the operator will additionally be accomplished regardless of whatever position shaft 354 and actuator plate 356 may be in, and will occur even if shaft 354 has been entirely released from its operating motor, whereupon the spring 402 will also drive the actuator plate 356 into the position shown in phantom in FIG. 5 wherein a protruding portion will interfere with stop means 328 to thereby establish a fixed position against which the spring 402 may act.

Figure 6:
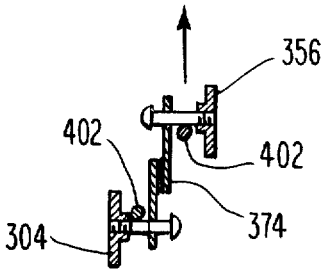
FIG. 6 is a cross-sectional view of a portion of the device shown in FIG. 5 taken as indicated by the lines and arrows 6—6 in FIG. 5.

In FIG. 6, the particular inter-arrangement of the fusible link 374, spring tips 402, actuator plate 356 and frame associated operating member 304 are clearly illustrated. While this embodiment is not automatically resetting, it nonetheless provides many of the advantages of that described in connection with the preferred embodiment illustrated in FIGS. 1 through 4, yet at a lower cost.

In FIG. 7 a cable actuated embodiment is shown which also retains many of the advantages of the preferred embodiment illustrated in FIGS. 1–4. In this embodiment, the frame associated member 304 is pivotally connected to frame mounting bracket 322 by a conventional, fixed pivot shaft 380 which extends outwardly therefrom. The stop means 328 acts to define the over-center locked position of the frame assoicated member 304 in the manner described above in connection with the embodiment of FIGS. 5 and 6. Since an actuator shaft and plate are not necessary in this embodiment, however, the spring 402 spans between one edge of the stop means 328 around a protruding portion of fixed pivot shaft 380 to an offset slotted portion of the frame associated member 304. The spring 402 nonetheless continues to act to continuously drive the frame associated member towards its over-center, locked position wherein it enages stop means 328. In the embodiment of FIG. 7 the actuator means for selectively causing the rotation of the frame assoicated member at least in a first direction away from the over-center position comprises a motor designated generally 364 which acts through a pulley on cable 368 which is threaded through ferrule 369 to fusible link 374, which in turn is connected to one of the operator members, preferably the frame associated operator member 304, in the vicinity of operator member pivot 306. In this manner, by causing the operator motor 364 to draw the cable in the direction of the arrow shown in FIG. 7, the damper will be caused to moved between its closed and open positions.

In addition to the advantages described above, the novel operator arrangements disclosed in FIGS. 1 through 7 possess the additional advantage of providing improved operator-damper actuation-air flow characteristics. During the initial phases in the opening of the damper through the preferred embodiment operators, relatively less blade rotation is accomplished for a give percentage of operator actuation. This phenomenon results from the fact that the paths of initial movement of the operator member pivot 306 and linkage rod 206, and more particularly linkage rod pivot 210, are transverse at the beginning of the cycle which opens the blades, while the paths of those arcs converge as the blades and operator approach their fully open (actuated) positions. Accordingly, at the beginning of the opening cycle, a given degree of actuation will produce relatively less rotation of the blades than at the end of the opening cycle, wherein the arcs defined by the linkage rod and the operator member pivot 306 are substantially coincident. Accordingly, it is within the scope of the present invention to measure the air flow characteristics of a given damper with which the operator of the present invention is to be used, to alter the various radii of the operator mmebers 302 and 304, and to further alter the length of the operating arc and locking arc of the actuator so that a given arc of actuator rotation will correspond in a substantially linear fashion to the percentage of air flow through the damper which is associated therewith.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the U.S. Patent and Trademark Office, and is not intended to limit the scope of the invention described and claimed herein.

What is claimed is:

1. An operator for operating a damper having a frame, at least one blade, and linkage means connected to said blade for articulating said blade with respect to said frame, said operator comprisng:

at least two operator members, said members, being pivotally interconnected with a first of said members being a frame associated member which is pivotally associated with said frame and a second of said members being a linkage associated member which is pivotally associated with said linkage means, said members being associated with said linkage means and said frame so that upon rotation of said frame associated member relative to said frame through an operating portion of its arc, said blade will be articulated relative to said frame, said articulation being between a fully open and fully closed position with respect to said frame, and further said frame associated member being adapted to be movable beyond said operating portion of said arc through a locking portion of said arc of rotation to an over-center position with respect to the pivot points of said members to lock said blade in said fully closed position.

2. The invention of claim 1 wherein said operator further comprises stop means adapted to limit the arc of rotation of at least one of said interconnected members.

3. The invention of claim 2 wherein said stop means engages one of said members in said over-center position.

4. The invention of claim 3 wherein said locking portion of said arc is greater than 0° and less than 7°.

5. The invention of claim 3 wherein said stop means engages said frame associated member.

6. The invention of claim 1 wherein said operator further comprises actuator means connected to at least one of said members for facilitating the rotation of said frame associated member in a first direction away from said over-center position.

7. The invention of claim 6 wherein said actuator means comprises a cable attached to at least one of said members.

8. The invention of claim 6 wherein said actuator means comprises shaft means associated with said frame associated member for selectively causing said rotation in said first direction in response to the rotation of said shaft means.

9. The invention of claim 6 wherein said actuator means further comprises releasing means for selectively releasing said actuator means from said at least one of said members.

10. The invention of claim 9 wherein said actuator means comprises resetting means for selectively reconnecting said actuator means to said at least one member.

11. The invention of claim 9 wherein said releasing means comprises a heat responsive releasing device.

12. The invention of claim 11 wherein said releasing means comprises a fusible releasing device.

13. The invention of claim 11 wherein said releasing means comprises a bimetallic releasing device.

14. The invention of claim 6 wherein said operator further comprises biasing means for biasing said frame associated member toward said over-center position.

15. The invention of claim 14 wherein said biasing means is connected between said frame associated member and said actuator means.

16. The invention of claim 14 wherein said biasing means is connected between said frame associated member and said actuator means.

17. A damper operator comprising:

(a) a mounting bracket having a bore defined therein;

(b) a rotatable actuating shaft journaled within said bore and further having an actuator plate fixedly attached thereto;

(c) a plurality of pivotally interconnected members, at least one of which is pivotally disposed around said shaft; and (d) actuating means for selectively engaging said interconnected members to said actuator plate so that rotation of said shaft causes said members to rotate therewith.

18. The invention of claim 17 wherein said actuating means comprises releasing means for disengaging said actuator plate with respect to said interconnected members to permit relative pivotal movement therebetween.

19. The invention of claim 18 wherein said actuating means cooperates with said mounting bracket to limit the axial movement of said shaft through an arc of rotation of at least 90°.

20. The invention of claim 19 wherein shaft is rotatable to a position wherein it may be axially moved with respect to said bore at least for assembly and disassembly.

* * * * *